US011651926B2

(12) United States Patent
Repenning

(10) Patent No.: US 11,651,926 B2
(45) Date of Patent: May 16, 2023

(54) CATHODE ASSEMBLY COMPONENT FOR X-RAY IMAGING

(71) Applicant: KONINKLIJKE PHILIPS N.V., Eindhoven (NL)

(72) Inventor: Thorben Repenning, Moorrege (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/733,170

(22) PCT Filed: Dec. 7, 2018

(86) PCT No.: PCT/EP2018/083899
§ 371 (c)(1),
(2) Date: Jun. 3, 2020

(87) PCT Pub. No.: WO2019/110775
PCT Pub. Date: Jun. 13, 2019

(65) Prior Publication Data

US 2021/0104373 A1 Apr. 8, 2021

(30) Foreign Application Priority Data

Dec. 7, 2017 (EP) ..... 17205884

(51) Int. Cl.
*H01J 35/06* (2006.01)

(52) U.S. Cl.
CPC ..... *H01J 35/066* (2019.05); *H01J 35/064* (2019.05)

(58) Field of Classification Search
CPC ..... H01J 35/066; H01J 35/064
See application file for complete search history.

(56) References Cited

U.S. PATENT DOCUMENTS

| | | | | |
|---|---|---|---|---|
| 4,979,199 | A * | 12/1990 | Cueman | H01J 35/147 378/121 |
| 5,031,200 | A | 7/1991 | Plessis | |
| 5,672,085 | A | 9/1997 | Knudsen | |
| 2001/0016027 | A1* | 8/2001 | Dinsmore | A61N 5/1001 378/65 |
| 2004/0090166 | A1* | 5/2004 | Sanders | H01J 35/14 313/448 |
| 2009/0022277 | A1* | 1/2009 | Bard | H01J 35/147 378/138 |
| 2010/0079053 | A1* | 4/2010 | Andrews | H01J 3/027 313/326 |
| 2016/0217965 | A1* | 7/2016 | Canfield | H01J 35/153 |
| 2018/0277331 | A1* | 9/2018 | Schultheis | H01J 35/045 |

FOREIGN PATENT DOCUMENTS

| | | |
|---|---|---|
| DE | 4021709 A1 | 1/1992 |
| JP | S63105427 A | 5/1988 |

OTHER PUBLICATIONS

Translation of JP 63-105427 A (May 10, 1988) (Year: 1988).*
PCT International Search Report, International application No. PCT/EP2018/083899, dated Apr. 30, 2019.

* cited by examiner

*Primary Examiner* — Chih-Cheng Kao
(74) *Attorney, Agent, or Firm* — Larry Liberchuk

(57) ABSTRACT

A cathode assembly component (CC) for X-ray imaging, comprising a monolithic outer shell (OS) with electron optical functionality and, insertable in said shell, an insulator structure (INS) for two or more electrodes.

20 Claims, 6 Drawing Sheets

CATHODE ASSEMBLY COMPONENT FOR X-RAY IMAGING

FIELD OF THE INVENTION

The invention relates to a cathode assembly component, to an X-ray source, to an X-ray apparatus, to a method of manufacturing a cathode assembly component, to a computer program element and to a compute readable medium.

BACKGROUND OF THE INVENTION

X-ray sources, sometime simply called X-ray "tubes", include as basic components an anode and cathode head to generate X-radiation for medical or non-medical purposes. These components are exposed to harsh conditions during use of the X-ray tube. For instance, the cathode operates under High Voltage (HV) and high temperature conditions. "HV" in this connection means that the cathode is held at a potential of up to 150 kV or even more relative to ground whilst "high temperature" means that the cathode head may experience temperatures of about 800° C., the cathode's emitter being exposed to even higher temperature of about 2400° C.

Heat management and efficient manufacture of cathode heads remains a challenge.

SUMMARY OF THE INVENTION

In order to address at least some of the above identified needs, there is provided, according to a first aspect, a cathode assembly component for X-ray imaging, comprising:

a monolithic (that is, a one-piece) outer shell having an electron optical functionality and, insertable in said shell, an insulator structure for two or more electrodes. The outer shell is formed from one-piece which ensures ease of manufacture and affords a flexibility of design variations as will be explained in more detail below.

The electron optical functionality helps forming an electron beam that emerges from the cathode assembly's emitter and this helps achieving a desired focal spot size at an anode of the cathode assembly. The electron optical functionality is achievable due to the shell being made from metal and/or by having the shell extend so as to at least partly surround the emitter. In embodiments, the shell has a portion for mouting the cathode assembly in an X-ray source of an X-ray imaging appratatus.

In one embodiment, it is also the insulator that is monolithic. In other words, the insulator is formed from one-piece of suitable insulator material, such as ceramic or other. The insulator is configured to thermally and/or electrically insulate electrical components of the cathode assembly. Preferably there is a single such insulator in the outer shell. Preferably the insulator is configured to furthermore hold one more of such electrical components. Examples of such components include electrodes/pins for one or more emitters or additional integrated electron beam forming components ("EBF"). Such EBFs are configured to shape the electron beam in length or width or both, or to regulated an intensity of the beam from a maximum intensity to zero. To this end, the insulator includes one or more through-holes for mounting the said components.

Having a single one-piece insulator inside a single one-piece shell allows better flexibility when mounting the above mentioned parts, such as additional emitters or additional EBFs.

The proposed shell design affords easy assembly when affixing (e.g. by brazing) the extra parts onto the insulator within the shell. The additional parts can be all mounted in a single step when producing a plurality (e.g., in the hundreds) of cathode assemblies in the same brazing furnace.

In particular pins/electrodes for EBFs can be added easily, such as two, three, four or more if required. Also plural emitters (of the flat or coiled type) can be accommodated by the design if required, and the manufacturing process can be adapted in a cost effective and easy manner. In other words, simpler assemblage with higher precision and reproducibility can be achieved.

In one embodiment, the shell has an integrated heat barrier to disturb heat flow from the emitter of the assembly towards the insulator. This allows better heat management.

In one embodiment, the heat barrier includes one or more apertures. This allows good heat management and in addition mechanical rigidity. In the alternative embodiment of the integrated heat barrier, the outer shell is locally thinned, that is, include one or more portions of reduced thickness.

In one embodiment, the shell is metallic. This includes pure metals such as Nickel, Molybdenum or Iron or alloys thereof such as Ni 42 or NiloK (Nickel-Cobalt-Iron) or other metals and alloys. Preferably the shell is formed from massive metal but metallic coatings may be used in the alternative.

Because in one embodiment the shell is (wholly) made of metal, this allows using in particular spark erosion to adjust a height of emitter to relative to an edge of the outer shell which allows cost effective manufacture.

In one embodiment, the insulator has a relieved structure. This allows achieving better high potential ("hipot") compliance and mechanical rigidity.

The proposed cathode assembly is suitable for different designs, including for flat emitters or coiled filament.

The proposed cathode assembly is envisaged in particular for multi-forming electrode. That is, the design affords improved isolation possibilities especially for additional integrated electron beam forming components ("EBF"). Such EBFs are configured to shape the electron beam in length or width or both, or to regulated an intensity of the beam from a maximum intensity to zero. EBFs may be made from wires, plates, sheet metals and other sub-components.

The proposed design integrates the possibility to optimize the design with regard to heat storage, thermal expansion and creepage.

According to a second aspect there is provided an X-ray source (tube) comprising a cathode assembly component as per any one of the above mentioned embodiments.

According to a third aspect there is provided an X-ray imager comprising a cathode assembly as mentioned above or an X-ray source as mentioned above.

According to a fourth aspect there is provided a method of manufacturing, comprising the step of forming a monolithic shell of a cathode assembly.

The method may further comprise mounting an insulator into said shell.

The step of forming of the monolithic shell is preferably done from a single block of material. The forming step is achieved either through subtractive machining such as CNC milling, laser cutting, or spark erosion (EDM) or other. Alternatively, or in addition, additive material forming techniques are used such as 3D-printing. Any of these techniques may be used also for forming the insulator.

In a further, optional step, one or more components (such as emitters, electrodes, electrical connections, etc) are mounted on the insulator within the shell.

According to a fifth aspect there is provided a computer program element, which, when being executed by at least one processing unit, is adapted to cause a material forming device to form at least a part of the cathode assembly as described above.

According to a sixth aspect there is provided a computer program element as described above, wherein said program element is a CAD file for 3D printing.

According to a seventh aspect there is provided a computer readable storage medium having stored thereon the program element as described above.

BRIEF DESCRIPTION OF THE DRAWINGS

Exemplary embodiments of the invention will now be described with reference to the following drawings wherein.

DETAILED DESCRIPTION OF EMBODIMENTS

Figure 1:
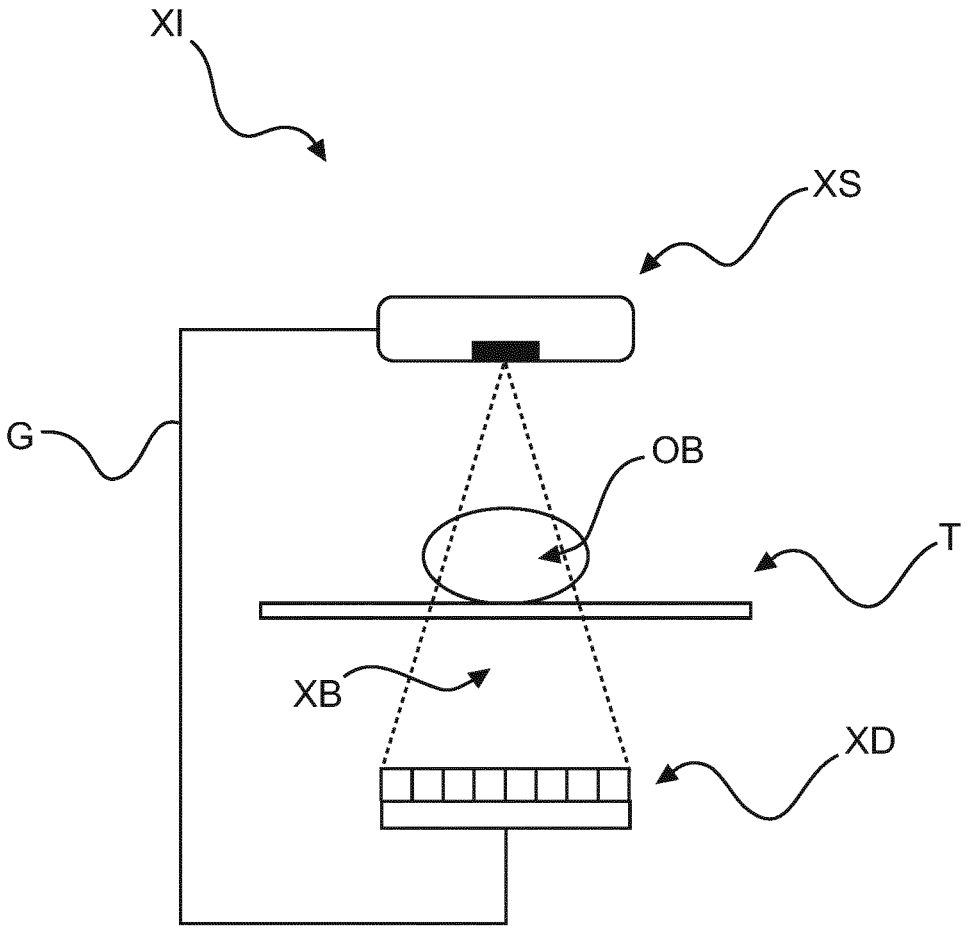
FIG. 1 shows a schematic diagram of components of an X-ray imaging apparatus.

With reference to FIG. 1, this is a schematic diagram of an X-ray imaging apparatus XI. Embodiments for this include a C-arm imaging apparatus, a CT scanner, a mammography apparatus or a radiographer apparatus, or other, configured to acquire an X-ray image of an object OB. Although main applications for the X-ray imager envisaged herein are in the medical field, non-medical contexts such as non-destructive material testing or baggage screening, etc. are not excluded herein. Accordingly, the terms "object OB" as used herein in the general sense to include inanimate objects but also animate objects such as a human or animal patients, or anatomic parts thereof. Accordingly, we will use herein "object OB" or "patient OB" where appropriate.

In broad terms, the X-ray imaging apparatus XI includes an X-ray source XS and an X-ray sensitive detector XD. In use, the object OB is positioned in an examination region within the X-ray source XS and the X-ray detector XD. To facilitate this, there is sometimes provided an examination table T on which the patient OB resides during the imaging although this may be so necessary in all embodiments. For instance, in alternate embodiments the patient OB is in the examination region during the X-ray examination.

In use, the X-ray source XS is energized to produce an X-ray beam XB which traverses the examination region and hence at least a region of interest of the object OB. The X-radiation interacts with matter (e.g., tissue, bones, etc.) of the object OB. After interaction, the radiation impinges on the X-ray detector XD. The impinging X-radiation is detected by the detectors XD in the form of electrical signals. The electrical signals are converted by suitable conversion circuitry into image values which may then be processed into X-ray images. The X-ray images are capable of showing details of the internals of the imaged object OB. This can help in diagnosis and therapy or other examination of the imaged object OB. Suitable rendering software may then be used to effect display of the imagery on one or more display devices, such as monitors, etc. The images may also be stored or otherwise processed.

Figure 2:
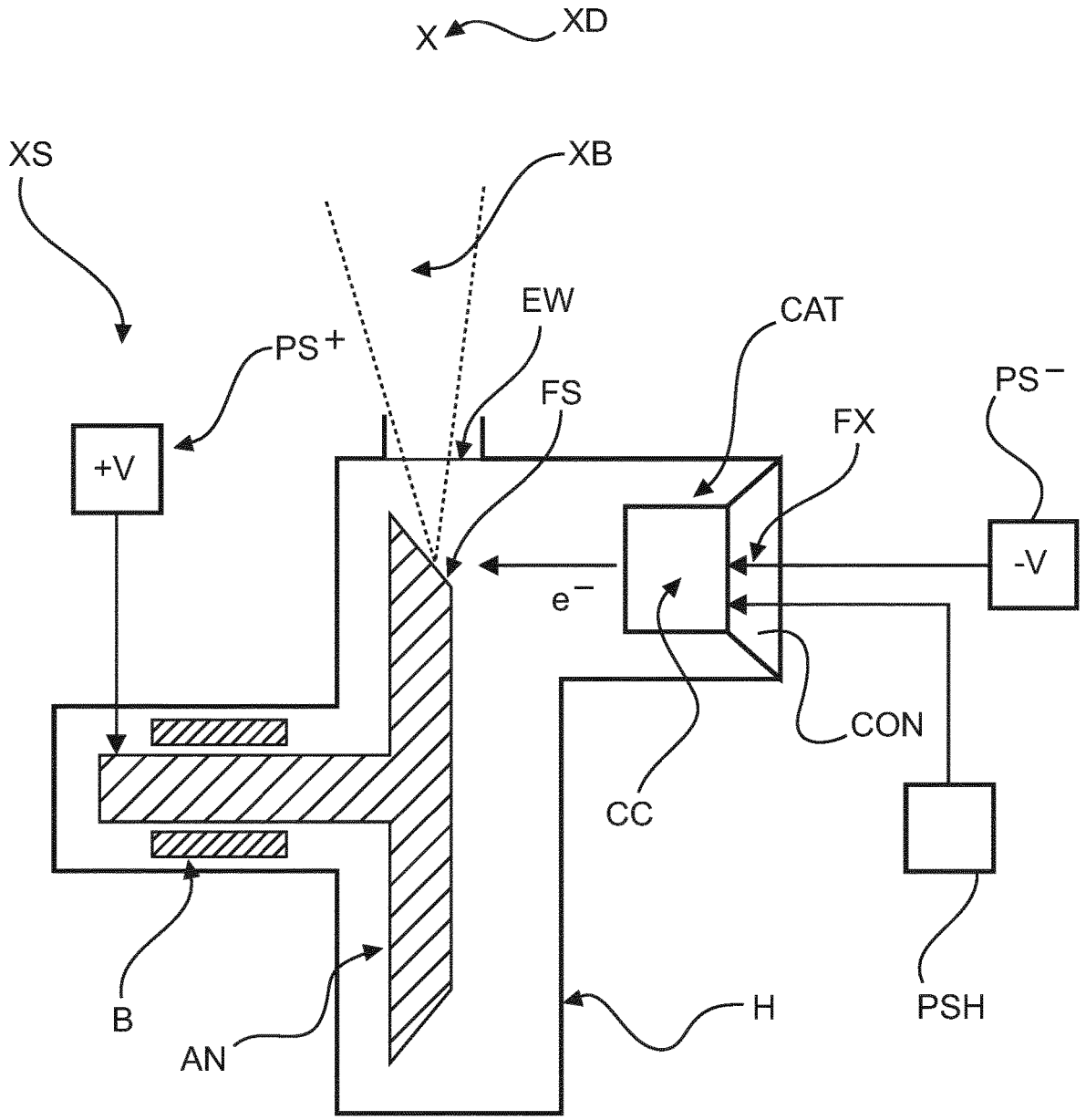
FIG. 2 shows a schematic cross-sectional view of an X-ray source.

FIG. 2 is schematic sectional view of the X-ray source XS. Broadly, the X-ray source XS includes an anode AN assembly (referred to herein as "the anode") and a cathode CAT assembly (referred to herein as "the cathode"). A high voltage electrical potential is established between the cathode CAT and the anode AN. This can be done as shown in the FIG. 2 by applying a negative voltage to the cathode CAT and a positive voltage to the anode AN by connecting the cathode and the anode to suitable power supplies PS. Suitable electrical connections CON are provided for this purpose at the source XS. In use, the anode AN and cathode CAT are held at a high voltage potential (referred to herein as "the tube voltage" or the "operation voltage") of about 150 KV relative to ground.

The cathode assembly CAT (also known as "cathode head") and the anode AN are arranged spatially in opposing relationship in a housing H to define a driftway between the cathode CAT and the anode AN. The anode AN and the cathode assembly CAT and the driftway are encased in an evacuated glass tube (not shown) inside the housing H. The housing provides protection against mechanical impact and enables mounting the in the X-ray imager XI. The housing may further include cooling circuitry and may provide further functions. Suitable materials for the housing includes ceramic, glass, metal or other.

Preferably, but not necessarily, the X-ray source XS is of the rotary type where the anode is arranged as a disc (shown in cross sectional side view in FIG. 2) which is rotatably journaled in suitable bearing B and driven by an electric motor suitably powered. X-ray sources with stationary anodes are also envisaged.

Figure 3A:
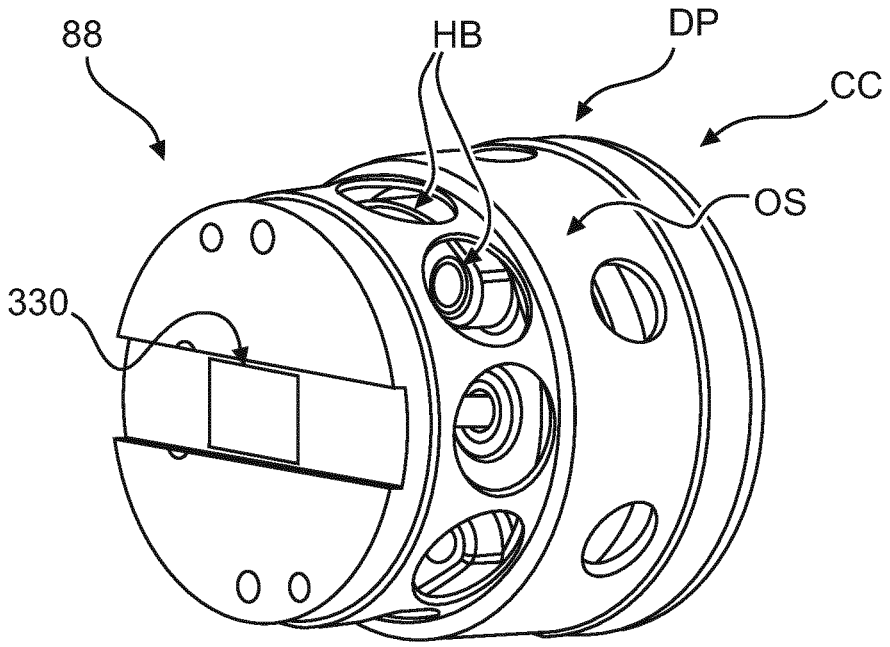
FIG. 3A shows a perspective view of a cathode cup for an X-ray source according to one embodiment.
Figure 3B:
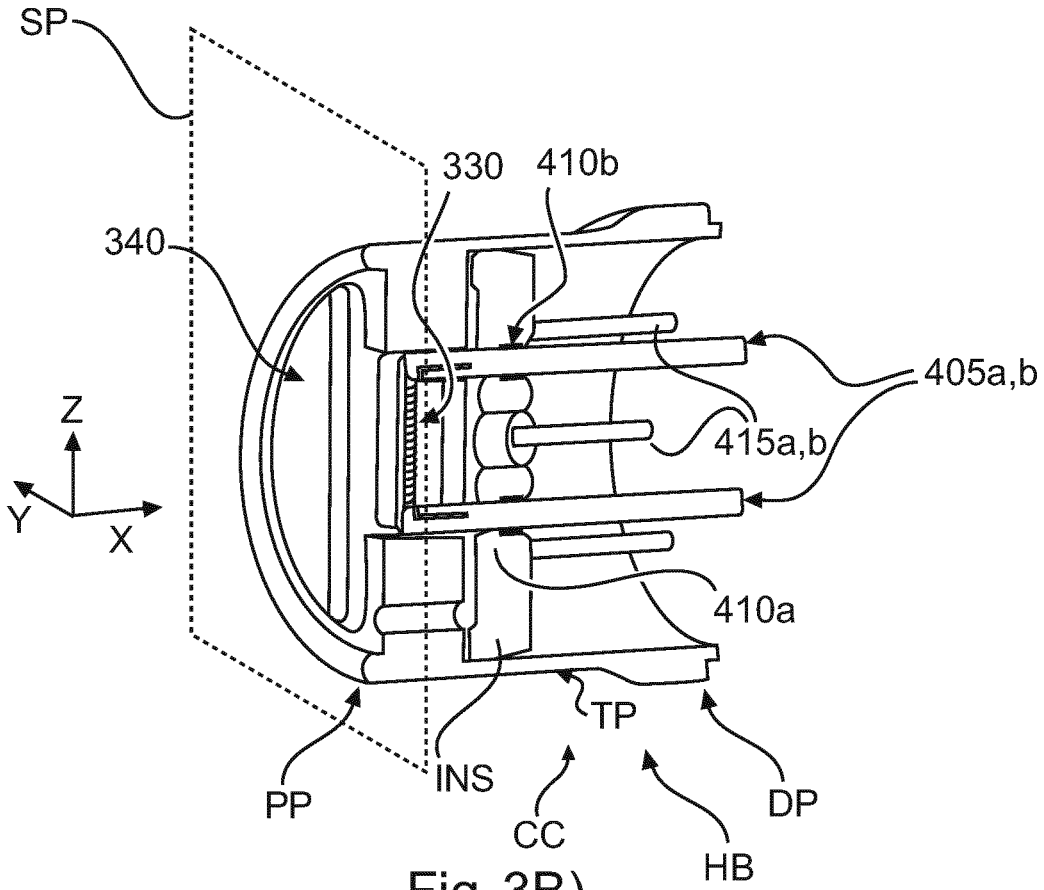
FIG. 3B shows a partly cut-away view of a cathode cup for an X-ray source according to a second embodiment.
Figure 4:
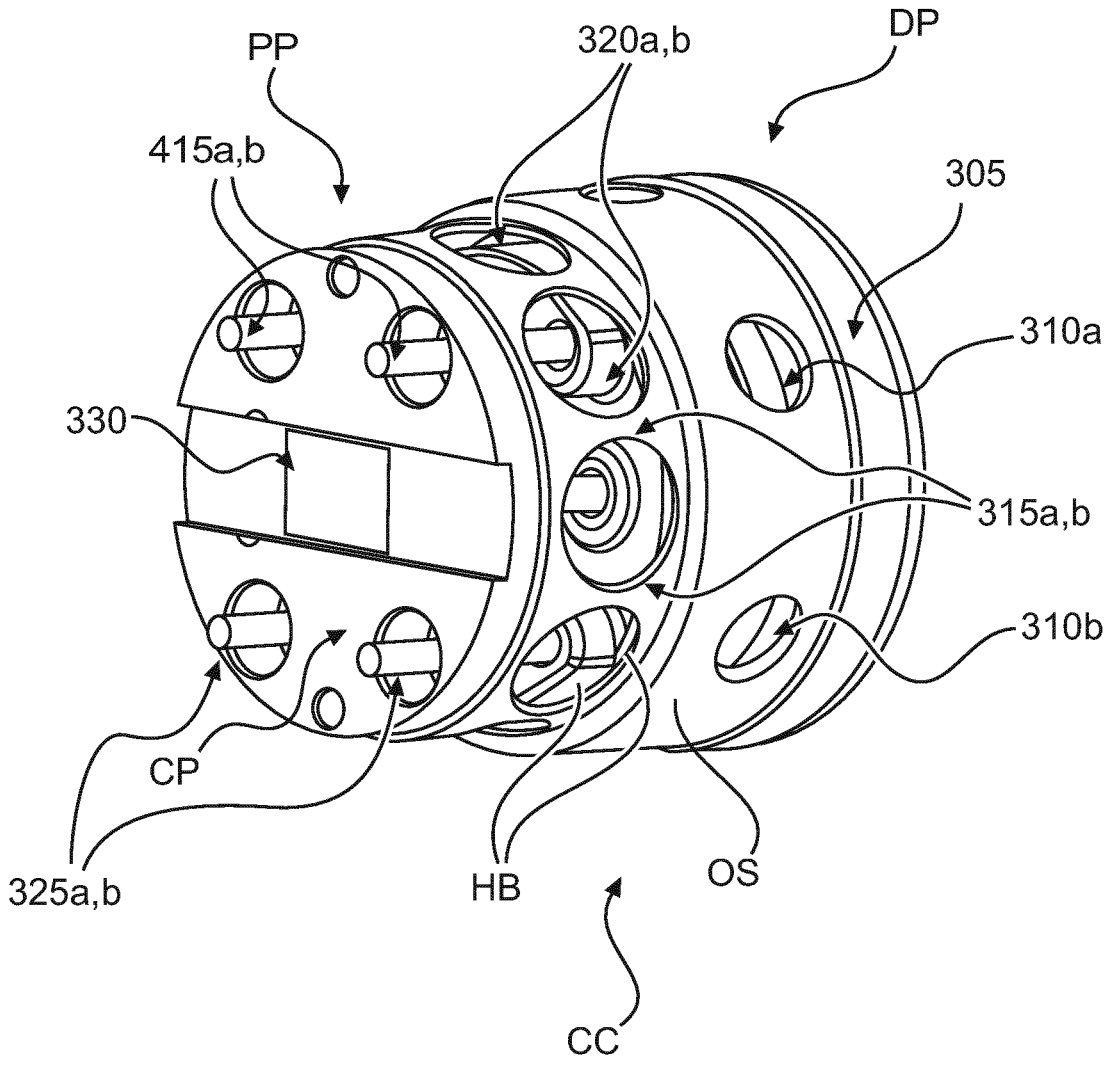
FIG. 4 shows a perspective view of a cathode cup for an X-ray source according to third embodiment.

The cathode assembly CAT includes an emitter 330 (not shown in FIG. 2, but shown in FIGS. 3,4). An electric current (referred to herein as "emitter current") is generated by a power source PSH. The emitter current is passed through the emitter 330 during use. It will be understood, that the three power sources PSH, $PS^-$, $PS^+$ are drawing as separate, independent densities and this is indeed envisaged in some embodiments. However this is not to exclude herein alternative embodiments where some or all of the mentioned power sources are integrated into a single power source.

The cathode assembly CAT includes as a component a cathode cup CC whose structure will be explained in more detail below. The cathode cup CC is arranged to hold the emitter 330 in place opposite the anode AN. The cathode cup CC is connected by a suitable fixture FX in and/or to the housing H. The cathode cup CC is arranged to hold the emitter at a distance from a fringe portion (in particular a beveled edge) of the anode AN in case the anode is of the rotatory type as shown in FIG. 2.

When the emitter current is applied, the emitter 330 heats up to a temperature of about 2400° and electrons are boiled off the emitter's surface 330 in thermic emission.

Because of the high potential difference between the cathode and the anode, the boiled of electrons form an electron beam which is accelerated towards the anode and impacts at the focal spot FS on the surface of the anode. In case of the rotatory anode, the focal spot is located on the beveled edge of the anode disc. It will be understood, that, due to the rotation, the focal spot FS traces out a track around the edge of the anode disc AN. The anode AN is formed from a high density material such as Molybdenum, Tungsten or other high-Z metal/material. When impacting at the focal spot FS, the electron beam XB decelerates and this energy drop is transformed partly into heat and partly (around 1%) into an X-radiation beam XB which radiates away from the focal spot FS. The housing H is radiation-blocking, for instance by having a leaden (or other suitable high Z material) layer to prevent the X-radiation from escaping outside the housing, safe for an egress window E of the housing formed from non-radiation opaque material such as glass. The X-radiation beam XR generated inside the X-ray source XS egresses then, essentially undisturbed, through the egress window EW to propagate towards the detector XD (whose relative position is indicated with an "x" in FIG. 2).

The heating current in the emitter and the impacting electron beam at the focal spot on the anode's surface cause a great amount of heat which calls for good heat management. This is achieved by holding the anode AN in rotation to provide better heat dissipation (and to increase the anode AN's life cycle) and/or through various cooling circuitry (which is not shown). In addition to this, heat management is also achieved herein by a novel structure of the cathode cup CC which will now be explained in more detail below at FIGS. 3A, B and 4.

Turning first to FIG. 3A, this is a perspective view of the cathode cup CC according to one embodiment. In this embodiment the cathode cup CC is generally of a cylindrical shape but other shapes such as prism shapes are also envisaged. Broadly, the cathode cup comprises a proximal part PP and a distal part DP. The proximal part PP is closer to the anode than the distal part DP when the cathode cup is mounted, by suitable fixture means FX, inside the housing of the X-ray tube XS.

Broadly, and as will be explained in more detail below, the cathode cup CC not only holds the emitter 330 in place relative to the anode AN, but it further provides electron optical functionality by focusing the emerging electron beam onto the focal spot FS of the anode AN at a suitable spatial definition, of about 1 mm-2 mm focal spot size.

The size and shape of the cathode cup will depend in general on requirements of the X-ray tube XS in which it is to be used. In one embodiment the maximum diameter at the distal portion DP is about several 10s of Millimeters which tapers into a smaller diameter at the proximal portion DR The total height/length of the cup CC, that is the distance between the distal portion DP and the proximal portion PP is about several 10s of Millimeters. In alternative embodiments, the tapering is reversed so that the proximal portion is larger than the distal portion. In yet other designs, the cup CC is of constant cross section without tapering. The variations in shape and dimensions described in this paragraph are of equal application to the other embodiments in FIG. 3B and FIG. 4.

As proposed herein the cathode cup CC has an outer shell OS. The outer shell OS is formed monolithically, that is, from one piece. The shell OS includes a heat barrier HB in the form of one or more apertures or by having a thinned portion reduced thickness (Shown in FIG. 3B). At the proximal portion, the emitters in this case flat emitters, are held in place opposite the anode surface. The single-piece outer shell OS is formed from metal. a single piece, in particular, and preferably a metallic block. Suitable metallic materials include Ni, Iron, Molybdenum or alloys thereof or other. Depending on the requirement the outer shell is several Millimeters thick (eg, 5 mm) in radial direction.

Inside the outer shell OS, and enclosed by same, is arranged an insulator INS. Preferably there is a single one-piece insulator per single shell OS. In other words, the proposed cathode cup uses a single metal shell (or hull) OS that forms the outside and this shell wholly or partly covers the single insulator INS.

The insulator is preferably formed of ceramic but other electrically insulating materials are also envisaged herein. The shape of the insulator conforms to the cross sectional shape of the outer shell to ensure a snug fit. In the following the insulator will be referred to as the ceramic disc with the understanding that other shapes as polygon are not excluded herein, depending on the cross section of the outer shell OS.

The function of the insulator INS includes to electrically and thermally insulate various electrical components and their electrical connections such as the emitter 330, or EBFs or other components of X-ray source XS.

More specifically, and as shown in sectional view as per FIG. 3B, the ceramic disc INS include a plurality of holes, in particular through-holes 410 *a, b*. Electrical lines 415 *a, b* (also referred to as pins) are passed through the through-holes and connect power source PSH with emitter 330. The pins are formed as rigid metal wires, about 2 mm in diameter but other diameters are also envisaged. Flexible cable wiring may also be used instead. Preferably, the emitter pins 415*a, b* are affixed by brazing or otherwise to the inner surface of the through-holes 410 *a, b*. Alternatively, the pins are not so affixed inside the through-holes but instead are held therein by friction or are freely held therein to better accommodate heat expansion.

The embodiment in FIG. 3B is similar to the one shown in FIG. 3A, but the respective emitters are different. The emitter 330 shown in the cross section of FIG. 3B is of the filament or coiled shaped type whilst flat emitters as shown in FIG. 3A. In other words, both types of emitters are envisaged herein in the alternative or in combination if various emitters are used. In flat emitters the filament, as opposed to the coiled filament type, the filament is instead deposited in a meandering layout on a flat surface. The heat current passes through pins 415*a, b* to heat the emitter 330 as briefly described above. If the cathode cup includes more than one emitter, for instance as shown in FIG. 3 where there are two flat emitters arranged side by side, the insulator disc INS includes more holes for the respective pair of pins to supply respective heat currents to the other emitter(s) 330. In general, the number of holes through the insulator INS is twice that of the number of emitters.

The cathode cup CC is largely the same for coiled filament emitter and flat emitters as per FIGS. 3A, B, but may differ in nature and location of the heat barrier and location of the insulator INS. In FIG. 3A the heat barrier is formed from through-holes in the outer shell. This holed-embodiment will be described further below at FIG. 4. In FIG. 3B on the other hand, the proximal PP has one or more sections of reduced thickness TP (only one section is shown in the Figure) and this forms the integrated heat barrier HB to reduce heat flow from the emitter in distal direction. No holes are required in the design of FIG. 3B.

As a further variant of the above described designs, it is the design of FIG. 3B that may include the heat barrier as holes whilst the heat barrier in FIG. 3A and FIG. 4 are formed instead by having the one or more thinned sections TP. It will be understood however that, as a further variant, the holes and tubing with sections of reduced thickness may be used in combination in alternative embodiments.

In the design of FIG. 3B the insulator is more proximal than in FIG. 3 and FIG. 4 although the converse is also envisaged.

In any of the embodiments proposed herein, the shell OS, of the cathode cup CC is configured to provide a passive electron optical functionality. In other words, the cup CC allows guiding or focusing the electron beam on its way through the driftway towards the anode AN to achieve a better spatial definition of the focal spot FS, down to 1 or 2 mm. This electron optical functionality is achieved by the metallic outer shell and by having the proximal portion PP extend sufficiently close to the emitter(s) 330. In other words, the proximal portion PP of the metallic outer shell at least partially encloses in cross section the emitter. In yet other words, and to put it geometrically, an imaginary sectional plane SP may be passed through the proximal portion PP of the outer shell so that this plane intersects the emitter 330. The plane is orthogonal to a longitudinal axis X of the shell OS as shown by the X, Y, Z co-ordinate system in FIG. 3B. In This imaginary sectional plane SP is orthogonal to the cross-section plane of the view as in FIG. 3B. The imaginary plane SP is given the Y, Z axes which are both essentially perpendicular to a primary propagation of the electron beam in direction –X. Although the geometry in terms of the sectional plane SP has been described with reference to FIG. 3B, the same geometry holds true for the other embodiments as per FIG. 3A and FIG. 4. In other words, such a sectional plane may be defined for all embodiments and each plane will preferably pass through the respective emitter.

As required, the electron optical functionality may be enhanced by mounting one or more EBFs with their electrodes as required. To this end, the cathode cup CC may further include additional pins 415*a, b* (that is, in addition to the pins of the emitter 330), which likewise pass through additional holes 410*a, b* in the ceramic disc INS to support and/or supply further components, in particular one or more EBFs. The EBF is positioned by way of the pins 415*a, b* between emitter 330 and anode AN. If a negative control voltage is applied thereto, the electron beam from the emitter towards the anode AN may be weakened or even completely interrupted. Conversely, if a positive voltage is applied the electron beam can be accelerated. The EBFs provide better imaging control to which off and on imaging safe patient dose. Switching imaging on/off rapidly is for instance required in some imaging modalities such as fluoroscopy or in gated imaging protocols when imaging moving anatomies such as in cardiac imaging or others. Preferably, the cup CC is configured for multi-EBFs, each with their own pair of supply and/or support pins 415*a, b*. Again, the number of through-holes (not shown in FIG. 3) for supporting and/or supplying the EBFs is twice the number of required EBFs. The EBFs may be arranged at different spatial orientation to each other.

Reference is now made to FIG. 4, which is similar to the embodiment of FIG. 3A, which shows in more detail pins 415*a, b* for the EBFs. The pins 415*a, b* pass through the insulator disc INS inside the outer shell and through through-holes 325*a, b* in a roof portion CP of the proximal portion PP of the outer shell OS. If there are more than one pair of such through-holes 325*a, b* (as shown in FIG. 4) these are preferably grouped around the one or more emitters 330.

FIG. 4 illustrates further details of the holed-embodiment of the heat barrier HB integrated into the outer shell OS of cathode cup CC as mentioned above in relation to FIGS. 3B,3B. The Embodiment in FIG. 4 largely corresponds to that in FIG. 3A. In this embodiment, the heat barrier HB is arranged as a series of holes 320*a, b* that are run around the circumference of the outer shell. The apertures 320*a,b* impede heat flow from the emitter 330 towards the distal portion DP of the cathode cup CC thus providing heat management. The series of apertures 320*a, b* are placed equidistantly at defined inter-aperture distances relative to each other to so leave only relatively narrow bar elements 315*a, b* in between any two neighboring apertures 320*a, b* for the heat to propagate. Non-equidistant placement of the apertures 320*a, b* is also envisaged in alternative embodiments.

One or more additional series of heat barrier apertures 310*a, b* may be placed distal from the first series. FIG. 4 shows one of such an additional series. The inter-aperture distances (and hence the width of the bar elements) in each series may be the same or may be different as shown in FIG. 4 where the inter-aperture distances in the second, more distal series, 310*a, b* are larger than the inter-aperture distances in the first, more proximal series 320*a, b*. As shown in the embodiment, the insulator is arranged in between the two series of heat barrier holes 310*a,b* and 320*a,b*.

It will be understood that the apertures 310*a, b*, 320*a, b* may not necessarily be circular through-holes as shown in FIG. 4, but other shapes are also envisaged herein, such as polygons etc. In yet another embodiment, the apertures 310*a, b*, 320*a, b* of the heat barrier HB may be elongated to form, in the shell OS, a lattice pattern or truss pattern. By arranging the heat barrier HB apertures 320*a, b* or 310*a, b* into the outer shell OS to form a lattice pattern or truss pattern, one can achieve not only better heat management, but also an increase in mechanical rigidity of the outer shell. In particular, this enhanced rigidity allows more accurately aligning the emitter 330 towards the focal spot FS thus resulting in enhanced imagery.

As briefly indicated above, the distal portion DP as shown in FIG. 4 includes a mounting portion 305, for instance a threaded portion, that allows mounting the cathode cup CC in the fixture FX of the source XS. Other types of mounting options are also envisaged, such as snap-fitting or other.

The tapering from the distal portion to the proximal portion of the cathode cup CC may either be continuous (not shown) or in steps as shown in the Figures.

As can be seen in the flat emitter 330 embodiments of FIG. 3A and FIG. 4 and similar designs, the emitter is arranged in a recess or depression in the cup roof CP. In the said embodiments, the shape of the recess conforms to that of the emitters 330, so is rectangular but other polygon shapes such as triangular, pentagonal or non-polygon such as circular are also envisaged in different embodiments.

In the alternative design of FIG. 3B where the emitter 330 is not flat but coiled, there is an exemplary embodiment 340 of an electrode insert of an EBF that is sunk into the outer shell, essentially flush with the proximal edge of the proximal portion PP. The electrode us supplied with current through the pins 415*a,b*. In this embodiment, the emitter 330 coil is t held in a cutout in the center portion of the cylindrical insert 340. The sunk insert may not necessarily be semi-cylindrical. Specifically, the electrode 340 preferably conforms to the cross section of outer shell OS so, for example, prism designs are also envisaged depending on the cross-section of shell OS. Similar electrodes may be used in the flat emitter designs of FIGS. 3A, and 4. The EBFs are not shown in FIG. 4, but only their supply pins 415*a,b*. FIG. 3A shows as design without EBFs.

Figure 5:
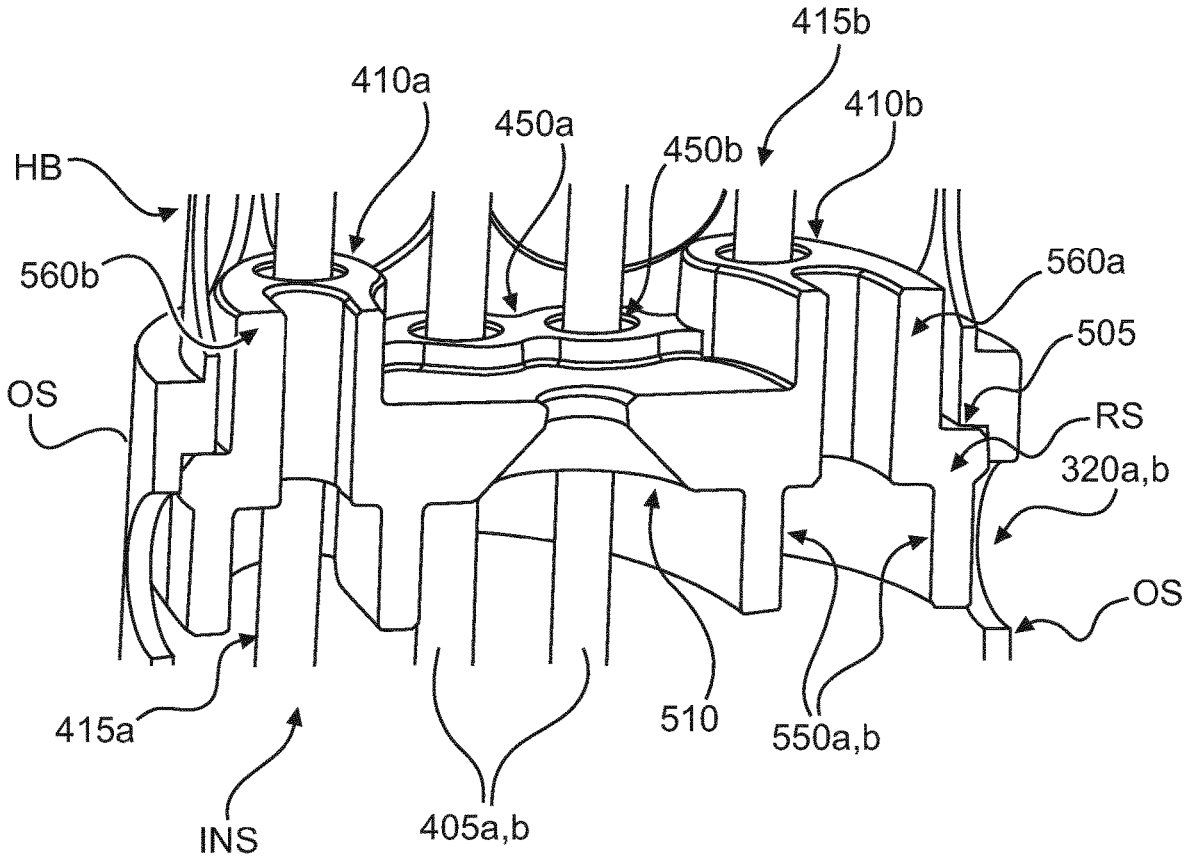
FIG. 5 shows a section view of an insulator according to one embodiment for insertion into a cathode cup.

Referring now to FIG. 5, this shows a partly cutaway close-up of FIG. 3A and FIG. 4. Specifically, FIG. 5 shows in more detail the insulator disc INS, preferably made wholly from ceramic. As mentioned, the insulator conforms in shape and size with an inner cross-section of the outer shell OS in which it is held. Preferably, the insulator disc INS is mounted to rest on and against shoulder portions 505 in the inner circumference of the outer shell OS. Preferably, the insulator INS is affixed to an inner surface and/or said shoulder portions 505 of outer shell OS. Affixing may be achieved preferably by brazing, or, alternatively, by sintering or gluing.

According to one embodiment, the insulator disc INS is relived, that is, it has an integrated relief structure RS formed in either or both faces of the disc. Both faces have reliefs in the embodiment shown in FIG. 5. The relief structure RS is defined by one or more wall portions 550*a, b*, 560*a, b* that jut out from the upper and/or lower face to project into proximal or distal directions, respectively. The relief structure RS allows for better mechanical rigidity and high voltage suitability (also known as "hipot" compliance). The insulator is configured to provide insulation against voltages of up to several kVs.

Preferably, but not necessarily, the wall portions 560*a, b*, 550*a, b* form, at the same time, walls of the through-holes 410*a, b* and 450*a, b* through the ceramic disc INS to accommodate the pins 415*a, b* for the EBFs and/or the feed pins 405*a, b* of the emitter 330, respectively. In other words, the through-holes 450*a, b*, 410*a, b* are embossed relative to the respective face (in case the proximal face) of the disc INS.

In one embodiment there is also one or more additional holes 510 formed in the body of the ceramic insulator INS. These additional through-holes may be referred to as drain holes. In embodiment FIG. 5 a single central drain hole 510 is shown. Preferably, the drain hole is funnel-shaped, so that the hole opens at different diameters into the two faces. Preferably, as shown in FIG. 5, the larger diameter opens in distal direction. The drain holes are useful when manufacturing the outer shell with the ceramic disc INS inserted in same. According to one embodiment, spark erosion is used in the manufacturing of the outer shell or when adjusting a height of the emitter 330 relative to the shell OS. The one or more drain holes 510 then facilitate rapid draining when flushing dielectric liquid in the spark erosion process. As an alternative to the relieved structure of the disc, this may be on either or both faces completely flat.

It will be understood that the various through-holes 410*a, b* and 450*a, b* through the single-bodied insulator INS allows to safely insulate the respective supply pins 405, 415 commonly, rather than insulating each pin 405, 415 separately by installing their respective, own insulator jacket. This allows saving costs in manufacturing and tighter per area packing of components, such as multiple emitters and/or multiple EBFs and/or other components.

As proposed herein, the, in particular ceramic, insulator INS is formed, like the outer shell OS, monolithically from a single block of ceramic or as the case may be from a block of other, suitable hipot insulating material. Any one or a combination of various machining techniques such as CNC milling or laser cutting are also envisaged and so are additive forming processes such as 3D printing.

In sum, the above proposed cathode assembly includes the cathode cup with the above described single bodied shell with electron beam optics for focusing, when fitted, the electron beam on the anode of the source XS. The proposed cathode cup design comprises two parts: a monolithic shell in which is fitted the monolithic single piece ceramic insulator. The insulator is configured for accommodating and insulating from each other various components, such as the electrical conductors or components. As mentioned above, such conductors/components include pins to feed the heat emitter or pins for one or more EBFs for controlling propagation of the electron beam. The EBFs are optional. If the design includes more than a single emitter, such as two or three, or more, each has a dedicated pair of feeding pins which are passed through the required number of through-holes in the disc and/or through the proximal part PP of the cathode cup CC.

As can be seen in the embodiments described above, the proximal portion terminates in a roof part CP to close off the shell OS but a proximally open design of the shell is also envisaged in the alternative. For instance, in one embodiment for such an open design, the roof part CP may be formed as a grid or trellis structure or, even simpler, there is no roof portion at all but instead there are one or more cross struts run across the cylindrical opening of the cathode cup shell OS to provide rigidity.

The exact form of the ceramic insulator can be adjusted to the requirements of a specific tube emitter. Creepage distances can be adjusted by additional wall elements.

Figure 6:
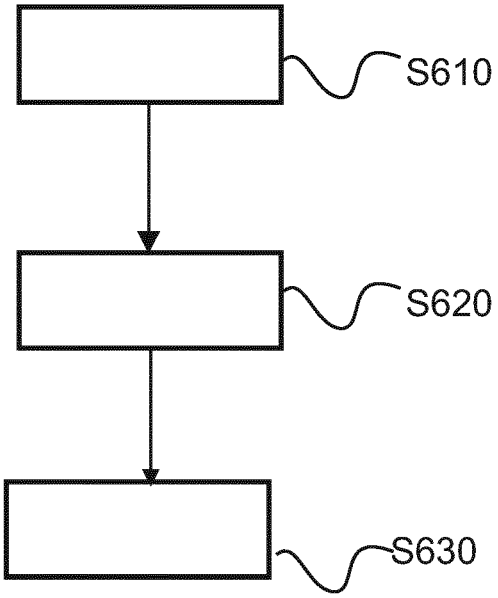
FIG. 6 shows a flow chart for a method of manufacturing a cathode cup.

Reference is now made to FIG. 6 where methods of manufacturing are discussed in more detail.

At step S610 the monolithic outer shell OS of the cathode assembly is formed. This can be done by additive forming processes such as 3D printing, or by more traditional, subtractive, machining such as CNC milling, laser cutting, spark erosion (also known as electrical discharge machining "EDM") or any other technique. Preferably, the outer shell OS is monolithic as it is formed from a single block of metallic material. The metal may be pure or may be an alloy. Suitable metals include Ni, Molybdenum, Iron or other. Suitably alloy include Ni 42 or NiloK or others. The outer shell is preferably formed from massive metal although metallic coating/layering or sputtering of a non-metallic substrate may be also envisaged. The various through-holes earlier described may be formed in a second process step by machining (such as milling or laser cutting) in the earlier formed shell or may by additively formed as the whole shell is build-up in voxel-wise, line-wise or per layer-wise fashion in additive manufacturing such as 3D printing.

In step S620 a monolithic insulator is mounted into the shell by brazing, welding, other fixing methods. Affixing in a pure friction fit may also be envisaged in the alternative. Preferably, the insulator is formed from one block, for instance ceramic by any of the above mentioned techniques such as machining, including CNC milling or (laser) cutting, boring, broaching, etc. Alternatively, additive forming such as 3D printing is also envisaged. The manufacturing of the ceramic insulator may also include pressing forming of ceramic clay and sintering.

The single one piece-metallic outer shell OS in combination with the single, one-piece insulator allows efficient mounting of pins/electrode structures for emitters or EBFs or others. This mounting S630 can be achieved in only one step by using a suitable brazing oven. Once the electrodes are in place in the insulator INS within the shell OS, mounting can be finalized in only one further step by spark erosion or other means to adjust the electrodes to the shell with the required accuracy by using spark erosion or similar techniques. Next, the emitter may be included in a next step and suitably adjusted, again by spark erosion or other techniques.

Figure 7:
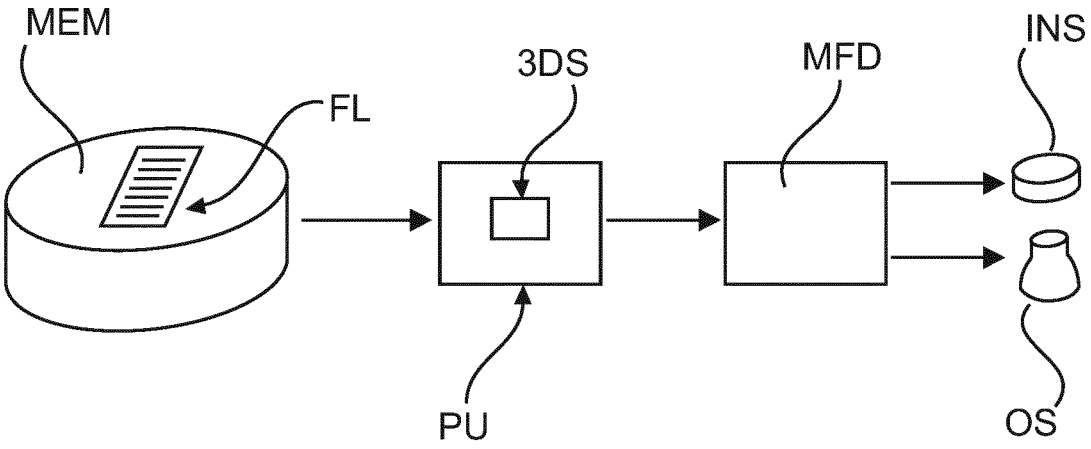
FIG. 7 shows schematic diagram of a work flow for manufacturing a cathode cup.

FIG. 7 shows a basic work flow diagram for 3D printing the outer shell or the inner insulator INS.

Information on the geometric structure and shape of the outer shell or insulator is described by a suitable CAD language in a suitable format such as STL, OBJ, PLY or other. This information is held in a computer file FL. In one embodiment this is a CAD file. The geometry in the geometry file FL is described by a collection of surfaces. Each surface is given by an orientation through its normal and vertices. The outer shell, or the shape of the outer shell or the insulator is then defined as a surface model built up from a collection of those surface elements.

The geometry describing file FL can be stored in a suitable memory MEM such as in permanent memory of a computing unit or on a moveable memory medium such as a memory stick, CD memory card or otherwise.

In embodiments, a data processing unit PU such as a laptop or desktop computer or tablet or one or more servers (with or without cloud architecture), or other suitable computing unit, runs 3D slicer software that reads in the geometric information from the geometry file FL and translates this into slices and related to commands suitable to control operation of the 3D printer MFD through suitable interfaces. Specifically, the 3D slicer translates the geometry information into code such as G code and C program language or others.

3D printing allows in particular to form more intricate structures for the heat barrier in the outer shell such as a more complex grid or truss work that not only impedes the heat flow but also confers better rigidity.

A similar work flow applies for instance for the case where the material forming device MFD is a CNC milling equipment.

The invention claimed is:

1. A cathode assembly for an X-ray imaging apparatus, comprising:

a monolithic outer shell having an electron optical functionality; and an insulator, insertable into the monolithic outer shell, for two or more electrodes, wherein the monolithic outer shell includes a cylindrical portion that surrounds the insulator, and that encloses the insulator within the monolithic outer shell, and the cylindrical portion surrounding the insulator and enclosing the insulator within the monolithic outer shell includes:

a contact surface that is in contact with the insulator; and a non-contact surface that is not in contact with the insulator, wherein the contact surface and the non-contact surface are monolithically formed, wherein the monolithic outer shell includes an integrated heat barrier to affect heat flow, and wherein the cylindrical portion includes a cylindrical outer surface, the cylindrical outer surface and the contact surface facing opposite sides to each other, wherein the integrated heat barrier includes at least one of:

an aperture formed at the cylindrical outer surface, and a thinned section at the cylindrical portion, the cylindrical portion including a raised section that raises, from the thinned section, outward of the cylindrical portion, wherein the thinned section is smaller in thickness than the raised section.

2. The cathode assembly according to claim 1, wherein the insulator is monolithic.

3. The cathode assembly according to claim 1, wherein the monolithic outer shell is metallic.

4. The cathode assembly according to claim 1, wherein the insulator has a relief structure.

5. The cathode assembly according to claim 1, further comprising an emitter.

6. The cathode assembly according to claim 1, wherein the monolithic outer shell is formed from a single block of material by at least one of:

i) 3D-printing, ii) milling, and iii) laser cutting.

7. The cathode assembly according to claim 1, wherein the insulator has a shape that conforms to a cross sectional shape of the cylindrical portion.

8. The cathode assembly according to claim 1, wherein the insulator is smaller, in size in an insertion direction in which the insulator is inserted into the monolithic outer shell, than the monolithic outer shell.

9. The cathode assembly according to claim 1, wherein an entirety of the insulator is disposed in the monolithic outer shell.

10. The cathode assembly according to claim 1, further comprising an electrically conductive pin electrically connected with one of the two or more electrodes, wherein the insulator includes a first part provided with a through hole through which the electrically conductive pin passes, the insulator includes a second part in contact with the contact surface, and the first and second parts of the insulator are formed with a same insulator material.

11. The cathode assembly according to claim 1, further comprising an electrically conductive pin electrically connected with one of the two or more electrodes, and wherein the cylindrical portion includes an inner surface that faces an inner side in a radial direction of a pin axis extending along the electrically conductive pin.

12. The cathode assembly according to claim 11, wherein the insulator is an insulator disc that includes an outer peripheral surface extending along a circumferential direction of the pin axis, the outer peripheral surface of the insulator disc faces an outer side of the radial direction of the pin axis, the inner surface extends along the circumferential direction of the pin axis, and the outer peripheral surface of the insulator disc is in contact with the contact surface.

13. The cathode assembly according to claim 1, wherein the monolithic outer shell includes an opening, and wherein the contact surface is spaced apart, in an insertion direction in which the insulator is inserted via the opening into the monolithic outer shell, from an edge of the opening of the monolithic outer shell.

14. The cathode assembly according to claim 13, further comprising an emitter, wherein the contact surface is located, in the insertion direction, between the emitter and each of the edge of the opening of the monolithic outer shell and the non-contact surface, and wherein the contact surface is spaced apart, in the insertion direction, from the edge of the opening of the monolithic outer shell across the non-contact surface.

15. The cathode assembly according to claim 1, wherein the cylindrical outer surface includes a circular or polygonal cross-sectional shape.

16. The cathode assembly according to claim 1, wherein the integrated heat barrier includes the aperture formed at the cylindrical outer surface.

17. The cathode assembly according to claim 1, wherein the integrated heat barrier includes the thinned section at the cylindrical portion, the cylindrical portion including the raised section that raises, from the thinned section, outward of the cylindrical portion, wherein the thinned section is smaller in thickness than the raised section.

18. An X-ray source, comprising:

an anode; and a cathode comprising:

a monolithic outer shell having an electron optical functionality; and an insulator, insertable in the monolithic outer shell, for two or more electrodes, wherein the monolithic outer shell includes a cylindrical portion that surrounds the insulator, and that encloses the insulator within the monolithic outer shell, and the cylindrical portion surrounding the insulator and enclosing the insulator within the monolithic outer shell includes:

a contact surface that is in contact with the insulator; and a non-contact surface that is not in contact with the insulator, wherein the contact surface and the non-contact surface are monolithically formed, wherein the monolithic outer shell includes an integrated heat barrier to affect heat flow, and wherein the cylindrical portion includes a cylindrical outer surface, the cylindrical outer surface and the contact surface facing opposite sides to each other, wherein the integrated heat barrier includes at least one of:

an aperture formed at the cylindrical outer surface, and a thinned section at the cylindrical portion, the cylindrical portion including a raised section that raises, from the thinned section, outward of the cylindrical portion, wherein the thinned section is smaller in thickness than the raised section.

19. A method of manufacturing at least a part of a cathode assembly for an X-ray imaging apparatus, comprising:

forming a monolithic outer shell having an electron optical functionality; and providing an insulator, insertable in the monolithic outer shell, for two or more electrodes, wherein the monolithic outer shell includes a cylindrical portion that surrounds the insulator and that encloses the insulator within the monolithic outer shell, and the cylindrical portion surrounding the insulator and enclosing the insulator within the monolithic outer shell includes:

a contact surface that is in contact with the insulator; and a non-contact surface that is not in contact with the insulator, wherein the contact surface and the non-contact surface are monolithically formed, wherein the monolithic outer shell includes an integrated heat barrier to affect heat flow, and wherein the cylindrical portion includes a cylindrical outer surface, the cylindrical outer surface and the contact surface facing opposite sides to each other, wherein the integrated heat barrier includes at least one of:

an aperture formed at the cylindrical outer surface, and a thinned section at the cylindrical portion, the cylindrical portion including a raised section that raises, from the thinned section, outward of the cylindrical portion, wherein the thinned section is smaller in thickness than the raised section.

20. The method according to claim 19, further comprising:

mounting the insulator into the monolithic outer shell.

* * * * *